US009803370B2

(12) United States Patent
Robert

(10) Patent No.: US 9,803,370 B2
(45) Date of Patent: Oct. 31, 2017

(54) CONSTRUCTION PANEL FOR INSTALLATION ON A FRAMEWORK

(71) Applicant: Placoplatre, Suresnes (FR)

(72) Inventor: Eric Robert, Suresnes (FR)

(73) Assignee: Placoplatre, Suresnes (FR)

( * ) Notice: Subject to any disclaimer, the term of this patent is extended or adjusted under 35 U.S.C. 154(b) by 80 days.

(21) Appl. No.: 14/761,294

(22) PCT Filed: Jan. 15, 2014

(86) PCT No.: PCT/EP2014/050717
§ 371 (c)(1),
(2) Date: Jul. 15, 2015

(87) PCT Pub. No.: WO2014/111428
PCT Pub. Date: Jul. 24, 2014

(65) Prior Publication Data

US 2015/0337539 A1 Nov. 26, 2015

(30) Foreign Application Priority Data

Jan. 15, 2013 (EP) ..... 13290009

(51) Int. Cl.

| | |
|---|---|
| ***E04F 13/21*** | (2006.01) |
| ***E04F 13/08*** | (2006.01) |
| ***E04C 2/04*** | (2006.01) |
| ***E04B 2/74*** | (2006.01) |

(52) U.S. Cl.
CPC ..... *E04F 13/0832* (2013.01); *E04B 2/7457* (2013.01); *E04C 2/04* (2013.01); *E04C 2/043* (2013.01); *E04F 13/0844* (2013.01)

(58) Field of Classification Search
None
See application file for complete search history.

(56) References Cited

U.S. PATENT DOCUMENTS 3,047,985 A * 8/1962 Murphy ..... E04F 13/0841 52/363
4,117,644 A * 10/1978 Weinar ..... E04F 13/0844 52/363
4,221,095 A * 9/1980 Weinar ..... E04B 2/7457 52/281

(Continued)

FOREIGN PATENT DOCUMENTS

DE 19934769 A1 2/2001
DE 102010026602 A1 1/2012

(Continued)

*Primary Examiner* — Elizabeth A Quast
(74) *Attorney, Agent, or Firm* — GrayRobinson, P.A.; Michael J. Colitz, III

(57) ABSTRACT

A panel comprises a board having a front face and a back face. The back face has a first edge and a second edge that is aligned with the first edge. A first set of tabs and a second set of tabs are attached to the back face, the first set of tabs being positioned along the first edge of the back face and the second set of tabs being positioned along the second edge of the back face, each individual tab being oriented transversely to the respective edge and protruding from the respective edge. The positions of the individual tabs on the first edge of the back face are offset from the positions of the individual tabs on the second edge of the back face.

12 Claims, 5 Drawing Sheets

(56) References Cited

U.S. PATENT DOCUMENTS

| | | | | | |
|---|---|---|---|---|---|
| 4,281,494 | A * | 8/1981 | Weinar | E04B 2/7411 | 52/346 |
| 4,498,272 | A * | 2/1985 | Adams | E04F 13/0844 | 52/363 |
| 4,844,651 | A | 7/1989 | Partridge | | |
| 4,897,978 | A * | 2/1990 | Menchetti | E04B 2/7457 | 52/363 |
| 5,345,739 | A * | 9/1994 | Menchetti | E04B 2/7457 | 428/122 |
| 2010/0180532 | A1 | 7/2010 | Martel | | |
| 2013/0186027 | A1* | 7/2013 | Sharpe | E04B 2/00 | 52/506.05 |
| 2014/0047778 | A1* | 2/2014 | DiGregory | E04B 1/34384 | 52/2.25 |
| 2014/0134373 | A1* | 5/2014 | Kalwara | E04D 13/064 | 428/41.8 |

FOREIGN PATENT DOCUMENTS

| | | | |
|---|---|---|---|
| EP | 0189437 | B1 | 4/1990 |
| WO | 9817881 | A1 | 4/1998 |
| WO | 2010035145 | A1 | 4/2010 |

* cited by examiner

CONSTRUCTION PANEL FOR INSTALLATION ON A FRAMEWORK

CLAIM OF PRIORITY

This application is a continuation of and claims priority under 35 U.S.C. §371 to International Application No. PCT/EP2014/050717 filed on Jan. 15, 2014, which in turn claims priority to EP 13290009.3 filed on Jan. 15, 2013. The contents of both these applications are incorporated herein by reference for all purposes.

The present invention relates to construction panels for installation on a framework, in particular to panels comprising gypsum board.

It is known to provide construction panels for installation on a framework, e.g. to provide a partition within a building. Such construction panels may comprise e.g. gypsum board.

It is desirable to provide construction panels that may be installed quickly and securely on a framework.

Therefore, in a first aspect, the present invention may provide a panel comprising a board having a front face and a back face, the back face having a first edge and a second edge aligned with the first edge, wherein a first set of tabs and a second set of tabs are attached to the back face, the first set of tabs being positioned along the first edge of the back face and the second set of tabs being positioned along the second edge of the back face, each individual tab being oriented transversely to the respective edge and protruding from the respective edge, wherein the positions of the individual tabs on the first edge of the back face are offset from the positions of the individual tabs on the second edge of the back face.

The offset between the positions of the two sets of tabs on the first and second edges has the effect that, if two panels according to the first aspect of the invention are aligned, such that the first edge of one panel abuts the second edge of the other panel, the tabs on the first edge will lie between the tabs on the second edge.

This arrangement has the effect that, once a first panel according to the first aspect of the invention has been secured to a framework, a second such panel may be positioned on the framework simply by slotting the tabs located on one edge of the second panel behind the board of the first panel, that is, into the gap between the first panel and the framework. It is not necessary to carry out a specific operation to secure the tabs on that edge of the second panel directly to the framework. Thus, the time required to install panels on the framework is reduced, and the process of installation simplified.

Additionally, as a result of the location of the tabs on the back face of the board (i.e. on the side of the board facing the supporting framework), the joints between adjacent boards (as seen from within the space that is bounded by the partition) are generally simple and uncluttered. This distinguishes the joints from many prior art systems in which jointing compound and jointing tape must be used to cover the joint, to render it visually acceptable. Since the present invention avoids the need to cover the joints, the process of installation of the panels may be further simplified.

Surprisingly, it has also been found that once multiple panels are installed on a framework, the resulting partition demonstrates a sound insulation performance that is comparable to that of a partition formed from conventional panels that are screwed directly to the framework, and hence have covered joints to conceal the screw heads.

It might be expected that the absence of joint coverings in partitions prepared using the panels of the present invention would result in a reduced sound insulation due to reduced damping of the panels in the joint region. However, it is thought that the beneficial effect of having intermittent contact between the panel and the framework, via individual tabs, rather than continuous contact, as observed in many conventional partitions in which the boards are screwed directly to the framework, may be sufficient to compensate for this. It is considered that the use of tabs effectively aids in decoupling the panel from the framework, thus increasing damping effects and aiding acoustic performance.

In general, each set of tabs provided on the panel is evenly spaced along the respective edge of the board. Typically, the spacing between adjacent tabs lies in the range 35-55 cm.

Typically, the positions of the tabs on the first edge are offset from the positions of the tabs on the second edge by an amount of 5-15 cm, preferably 8-12 cm.

Preferably, the tabs of the first and second sets of tabs protrude by 1-2 cm from the first and second edges respectively, preferably by 1.3-1.7 cm.

In general, the tabs of the first set of tabs each have an aperture provided in the protruding portion of the tab, to allow the tabs to be secured to a framework e.g. by a screw. Typically, the portion of the tab material that bounds the aperture is bent in a direction away from the board to provide a frustoconical boundary for the aperture. Although such an aperture may not be required on the tabs of the second set of tabs, in practice both sets of tabs have the same features, in order to simplify the process of manufacture and installation of the panels.

The tabs of both sets of tabs each typically have a raised rim extending around their perimeter, the rim extending in a direction away from the board.

Additionally, the protruding portions of the tabs generally comprise a region that is pressed to provide a dimple on the side of the tab furthest from the board and a corresponding nodule on the side of the tab closest to the board. For example, two such pressed regions may be provided in the protruding portion of the tab, one on each side of an aperture.

By providing tabs that are not completely planar but that comprise features extending away from the plane of the tab, it is thought that the contact area between the tab and the framework may be reduced, thus decreasing the level of coupling between the board and the framework and so improving acoustic performance.

Tabs may be formed from a variety of materials e.g. plastics, fibre composites or metal.

In general, the tabs are secured to the board by means of adhesive tape. The adhesive tape may comprise acoustic foam to reduce sound transmission between the board and the framework. Additionally or alternatively, acoustic foam may be provided at the interface between the tabs and the framework or directly between the board and the framework.

In a second aspect, the present invention may provide a tab having one or more of the features of any tab provided on the panel according to the first aspect of the invention, for retro-fitting to a board.

In a third aspect, the present invention may provide a kit comprising a panel according to the first aspect of the invention and a boundary panel, the boundary panel comprising a board having a set of tabs positioned along an edge of a back face of the board, each tab being oriented transversely to the edge and protruding from the edge, the back face of the board additionally being provided with means for joining the board to a stud framework, the means being located within the perimeter of the back face.

Since the boundary panel only has tabs provided along one edge, it may be positioned with its opposite edge abutting the face of a previously-prepared wall or partition. Thus, the boundary panel may provide a first element in a new partition e.g. for the subdivision of a previously large room.

The means joining the board to the stud framework may be e.g. one or more portions of adhesive tape In a fourth aspect, the present invention may provide a structure for providing a partition within a building, the structure comprising at least two panels according to the first aspect of the invention, and a framework, wherein the first set of tabs of the first panel is attached to the framework, and the second set of tabs of the second panel is slotted between the first panel and the framework.

In general, the first set of tabs of the first panel is attached to the framework by means of screws passing through respective apertures in the protruding portions of the tabs.

In a fifth aspect, the present invention may provide a method of providing a partition within a building, comprising the steps of:

providing two panels according to the first aspect of the invention and a framework;

attaching the first set of tabs of the first panel to the framework; and slotting the second set of tabs of the second panel between the first panel and the framework.

The step of attaching the first set of tabs of the first panel to the framework generally comprises passing screws through corresponding apertures in the protruding portions of the tabs.

The invention will now be described by way of example with reference to the following Figures in which.

Figure 1:
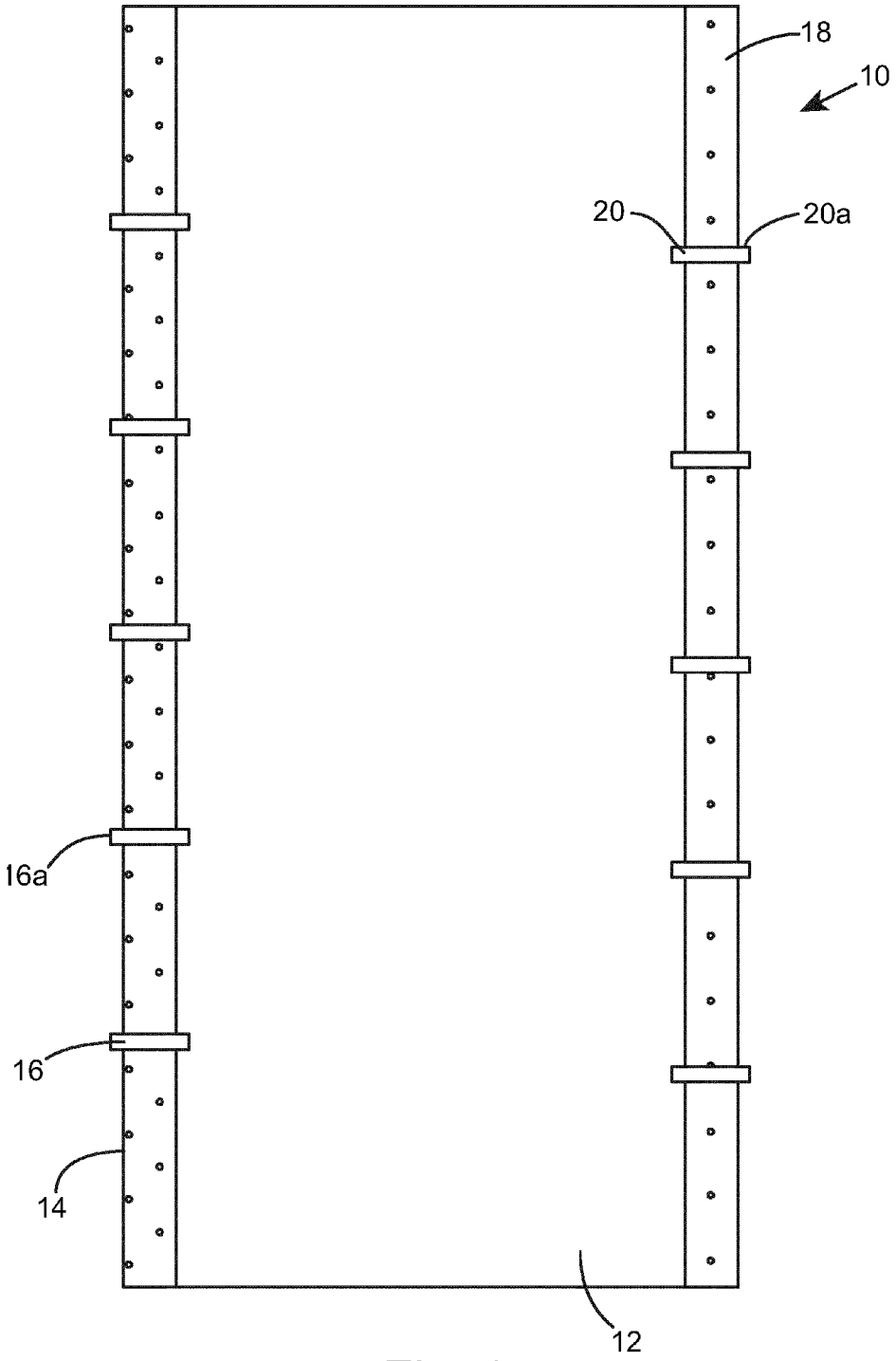
FIG. 1 is a plan view of a panel according to a first aspect of the invention.

Referring to FIG. 1, a panel 10 comprises a board 12 (e.g. a gypsum board). The first longitudinal edge 14 of the board 12 is provided with a first set of tabs 16. The tabs 16 each extend transversely to the longitudinal edge 14 and comprise a portion 16*a* that protrudes from the edge 14. The tabs 16 are spaced at intervals of 40 cm.

The second longitudinal edge 18 of the board 12 is provided with a second set of tabs 20. The tabs 20 each extend transversely to the longitudinal edge 18 and comprise a portion 20*a* that protrudes from the edge 18. The tabs 20 are spaced at intervals of 40 cm. Each tab in the second set of tabs is offset by 10 cm from a corresponding tab in the first set of tabs, the offset distance being measured along a longitudinal direction of the board.

All the tabs are attached to the board by means of double-sided tape. The tabs each protrude from the corresponding edge by 1.45 cm.

Figure 2:
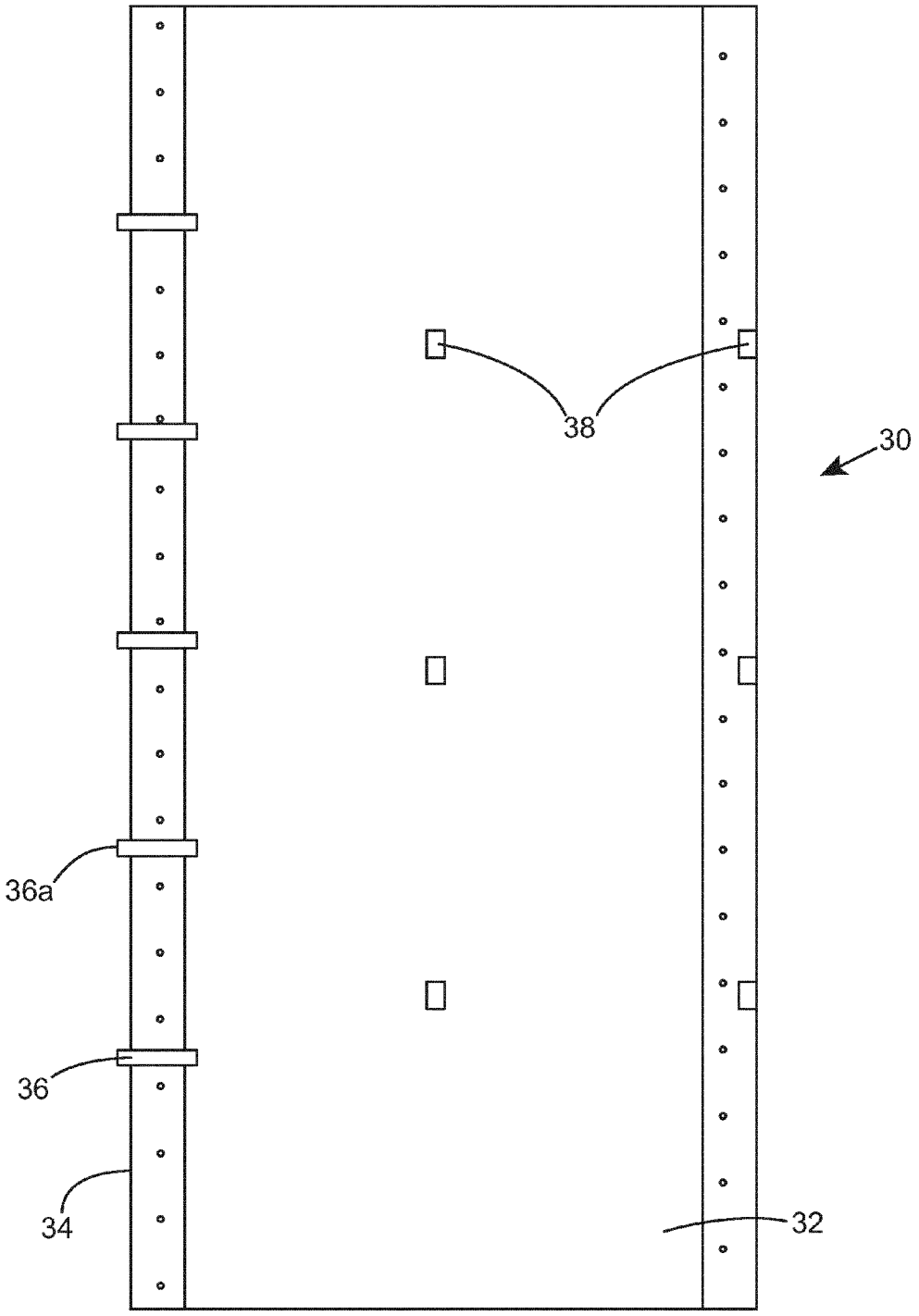
FIG. 2 is a plan view of a boundary panel for use in a kit according to a third aspect of the invention.
Figure 4:
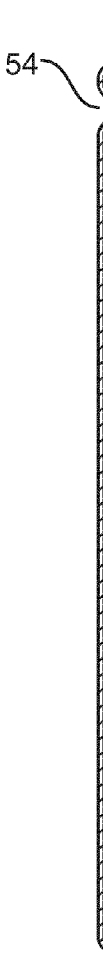
FIG. 4 is a section view of the tab of FIG. 3, taken along line A-A.
Figure 3:
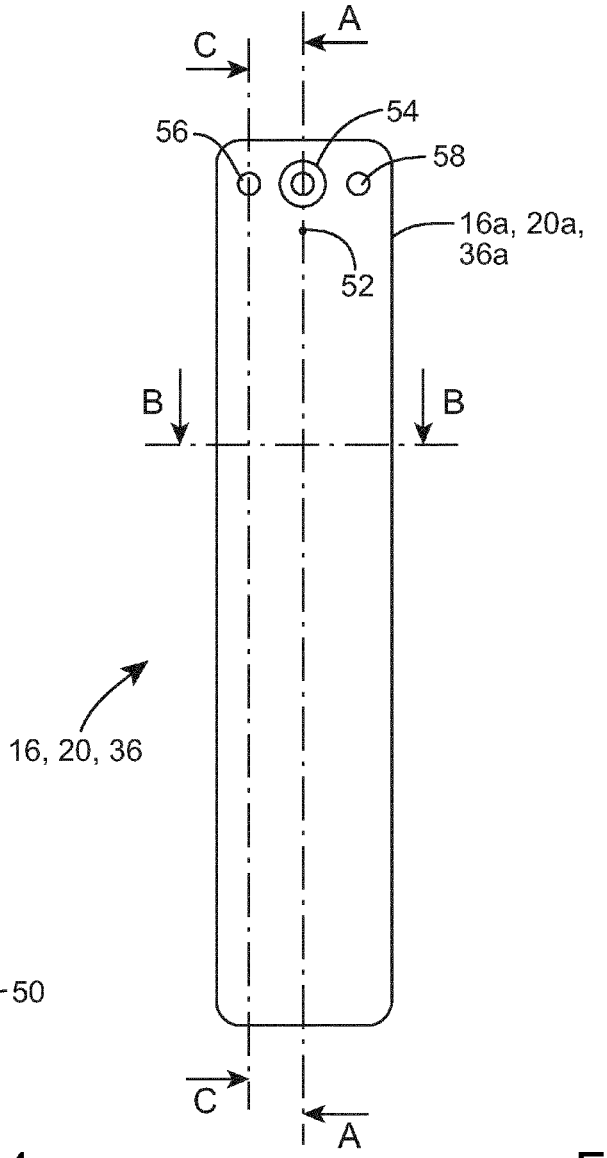
FIG. 3 is a plan view of a tab providing part of the panel of FIG. 1 or FIG. 2.
Figure 6:
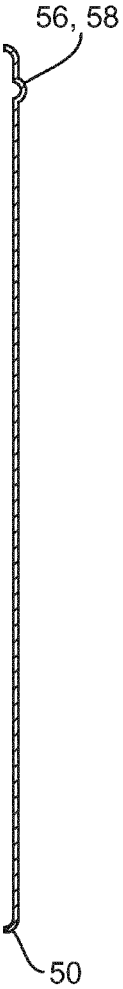
FIG. 6 is a section view of the tab of FIG. 3, taken along line C-C.
Figure 5:
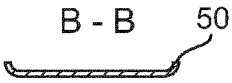
FIG. 5 is a section view of the tab of FIG. 3, taken along line B-B.

Referring to FIG. 2, a boundary panel 30 comprises a board 32 (e.g. a gypsum board). A set of tabs 36 is provided along only one longitudinal edge 34 of the board. The tabs 36 each extend transversely to the longitudinal edge 34 and comprise a portion 36*a* that protrudes from the edge 34. Portions of adhesive tape 38 located within the edges of the board provide further means for securing the board to a framework.

Referring to FIGS. 3-6, a tab 16,20,36 (e.g. any one of the tabs attached to the boards 12,32 shown in FIGS. 1 and 2) has a generally planar form, but comprises a raised rim 50 extending around its perimeter. The width of the tab is 3 cm and the length of the tab is 15 cm. The thickness of the tab in its planar region is 0.3 mm. The tab 16,20,36 has a generally rectangular shape, in which the corners are rounded off.

An end section 16*a*,20*a*,36*a* of the tab is configured to provide a portion for protrusion from the respective edge of the board on which the tab is mounted. The boundary of the end section is marked by a small indent 52. The end section 16*a*,20*a*,36*a* comprises an aperture 54 that is located between two pressed portions 56,58.

The portion of the tab surrounding the aperture 54 is shaped to provide a frustoconical surface. The frustoconical surface extends on the same side of the tab as the raised rim 50.

The two pressed portions 56,58 comprise portions of the tab that are each shaped to provide a dimple on one face of the tab and a corresponding nodule on the opposite face of the tab. The dimple parts of the pressed portions 56,58 are located on the same face of the tab as the raised rim 50.

The tab is mounted on the board such that the rim 50 and the frustoconical surface of the aperture 54 extend in a direction away from the board. The dimple parts of the pressed portions 56,58 are on the face of the tab furthest from the board, while the nodule parts are on the face of the tab that contacts the board.

Figure 7:
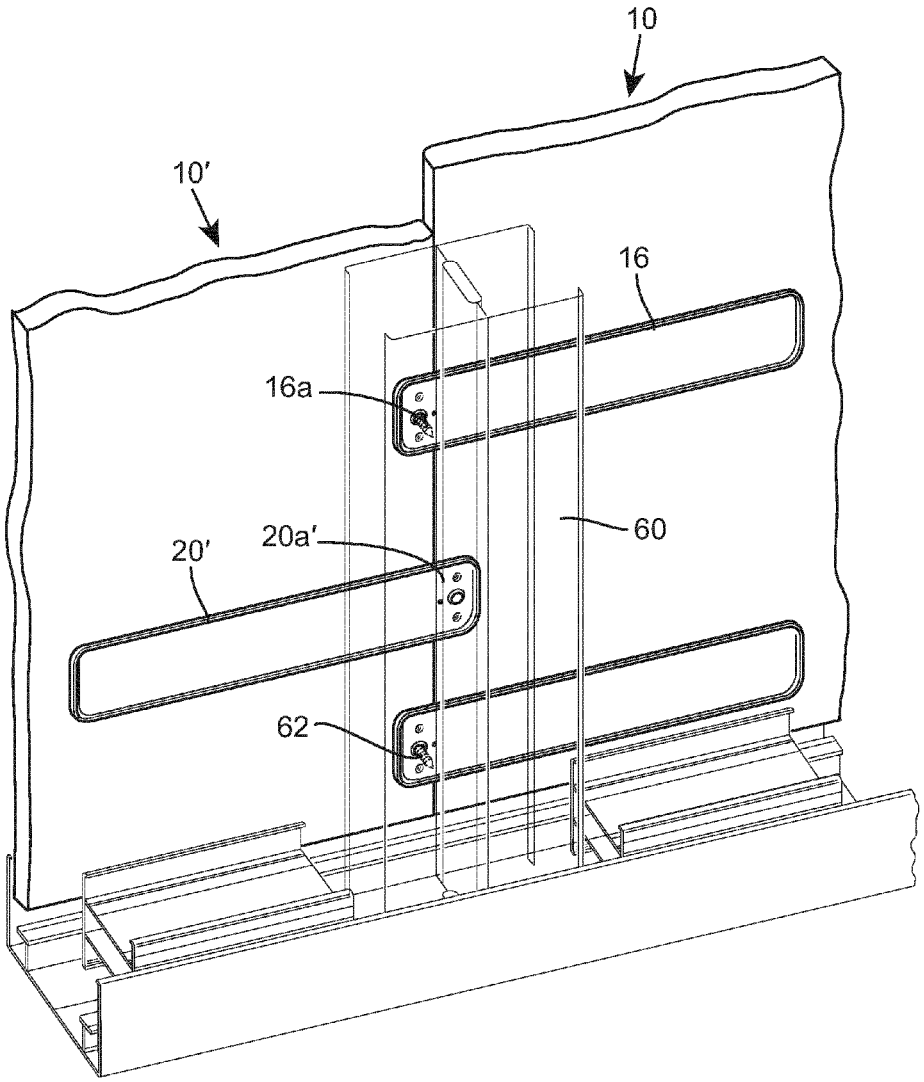
FIG. 7 is a perspective view of a structure according to a fourth aspect of the invention.

Referring to FIG. 7, a first panel 10 (e.g. a panel such as that shown in FIG. 1) is secured to a framework 60 by means of screws 62 that pass through corresponding apertures 54 in the protruding portions 16*a* of tabs 16. A second panel 10' (e.g. another panel such as that shown in FIG. 1) has tabs 20' having protruding portions 20*a*', the protruding portions being slotted into the gap between the first panel 10 and the framework 60. The presence of pressed portions 56,58 and the resiliently flexible nature of the tab material help to ensure a tight fit of the protruding portion 20*a*' between the first panel 10 and the framework 60.

In use, a boundary panel 30 (e.g. a panel such as that shown in FIG. 2) provides a starting panel for a partition. The panel 30 only has protruding tabs along one longitudinal edge 34 of the board 32, and so the other longitudinal edge may be positioned abutting the face of a previously-built wall or partition. The tabs of the boundary panel are then secured to the framework 60 by means of screws 62, while the portions of adhesive tape 38 provide further means for attachment to the framework.

The protruding portions 20*a* of the tabs 20 provided along the second longitudinal edge 18 of the main panel 10 (e.g. a panel such as that shown in FIG. 1) are then slotted between the boundary panel 30 and the framework 60. The offset between the tabs on the abutting edges 18,34 of the main and boundary panels 10,30 allows individual tabs provided on the second longitudinal edge 18 of the main panel 10 to fit between adjacent tabs provided on boundary panel 30. Thus the protruding portions 20*a* of the tabs provided along the second longitudinal edge 18 of the main panel 10 are held in abutting non-bonded contact between the boundary panel 30 and the framework 60.

The protruding portions 16*a* of the tabs 16 provided along the first longitudinal edge 14 of the main panel 10 are then secured to a further portion (not shown) of the framework 60 via screws passing through apertures 54. Further panels of the type shown in FIG. 1 may then be added to the partition by repeating the steps of i. slotting one set of tabs between a previously-mounted panel and the framework;

ii. securing the other set of tabs to a further portion of the framework by means of screws passing through the apertures in the tabs.

The following worked example is presented by way of illustration only.

EXAMPLE 1

12.5 mm thick gypsum boards having a density of 9.6 kg/m$^2$ were provided with metallic tabs along the longitudinal edges of their back faces. The tabs were attached to the board by means of double-sided adhesive tape. The spacing of the tabs along each edge was about 40-50 cm, and the offset between tabs on opposite edges was about 10 cm.

The boards were installed on a framework to provide a double-sided partition. Glass wool was provided in the cavity between the two sides of the partition. The acoustic performance of the partition was measured according to NF EN ISO 140-3 and NF EN ISO 717-1.

COMPARATIVE EXAMPLE 1

12.5 mm thick gypsum boards having a density of 8.9 kg/m$^2$ were installed on a framework to provide a double-sided partition. The boards were secured to the framework by means of screws passing through apertures provided in the boards. The joints between adjacent boards were treated with jointing compound and covered with a paper sheet. Glass wool was provided in the cavity between the two sides of the partition.

The acoustic performance of the partition was measured according to NF EN ISO 140-3 and NF EN ISO 717-1.

Acoustic Testing Results

Figure 8:
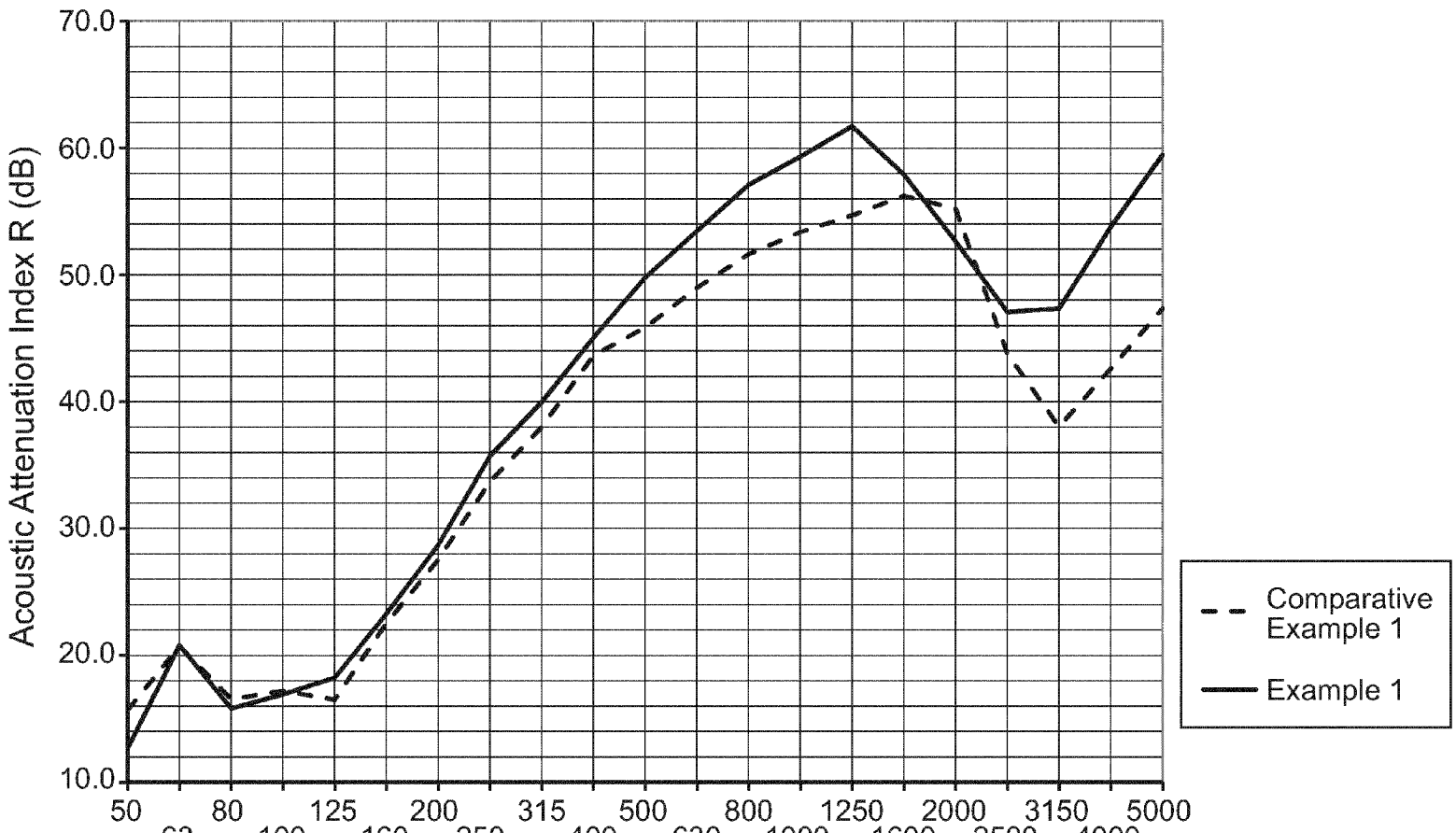
FIG. 8 is a graph of sound insulation index as a function of frequency, as measured for Example 1 and Comparative Example 1.

FIG. 8 shows a graph of sound insulation index as a function of frequency for Example 1 and Comparative Example 1.

At frequencies between about 100 and 400 Hz, the sound insulation index for Example 1 is slightly higher than that of Comparative Example 1. This is thought to be due to the slightly higher density of the board of Example 1. In the middle and high frequency regions above 400 Hz, Example 1 demonstrates a significantly increased sound insulation index relative to Comparative Example 1. This is considered to be due to the fact that the indirect connection between the boards and the framework in Example 1 results in a decoupling effect that increases the sound insulation capabilities of the partition, and which more than compensates for the absence of joint coverage.

The invention claimed is:

1. A first panel comprising a board having a front face and a back face, the back face having a first edge and a second edge aligned with the first edge;

a first set of tabs and a second set of tabs attached to the back face of the first board, the first and second set of tabs being made up of individual tabs, the first set of tabs being positioned along the first edge of the back face and the second set of tabs being positioned along the second edge of the back face, the first set of tabs being oriented transversely to the first edge and protruding from the first edge, the second set of tabs being oriented transversely to the second edge and protruding from the second edge;

the positions of the individual tabs on the first edge of the back face are offset from the positions of the individual tabs on the second edge of the back face;

a protruding portion of the individual tabs of the first set of tabs that protrudes from the first edge comprises a region that is pressed to provide an indented dimple on the side of the tab furthest from the back face of the board and a corresponding raised nodule on the side of the tab closest to the back face of the board.

2. A panel according to claim 1, wherein adjacent tabs of the first set of tabs and adjacent tabs second set of tabs are spaced apart by a gap between the adjacent tabs, the gap being in the range 35-55 cm wide.

3. A panel according to claim 1, wherein the positions of the first set of tabs on the first edge are offset from the positions of the second set of tabs on the second edge by an amount of 5-15 cm.

4. A panel according to claim 1, wherein the tabs of the first and second sets of tabs protrude by 1-2 cm from the first and second edges respectively.

5. A panel according to claim 1, wherein the first set of tabs and second set of tabs are attached to the board by means of adhesive tape.

6. A panel according to claim 1, wherein the first set of tabs and second set of tabs have a raised rim extending around a perimeter thereof, the rim extending away from the board.

7. A panel according to claim 1, wherein the tabs of the first set of tabs each have an aperture provided in a protruding portion of the tab, the protruding portion of the tab protruding outwardly from the first edge.

8. A panel according to claim 7, wherein a portion of the tab material that bounds the aperture is bent away from the board to provide a frustoconical boundary for the aperture.

9. A kit comprising a panel according to claim 1 and a boundary panel, the boundary panel comprising a boundary panel board having a third set of tabs positioned along an edge of a back face of the boundary panel board, each tab of the third set of tabs being oriented transversely to the edge and protruding from the edge of the boundary panel, the back face of the boundary panel board additionally being provided with means for joining the board to a stud framework, the means being located within the perimeter of the back face of the boundary panel board.

10. A structure for providing a partition within a building, the structure comprising a first panel according to claim 1, a second panel according to claim 1, and a framework, wherein the first set of tabs of the first panel is attached to the framework, and the second set of tabs of the second panel is slotted between the first panel and the framework.

11. A method of providing a partition within a building, comprising the steps of:

providing a first panel according to claim 1, a second panel according to claim 1, and a framework;

attaching the first set of tabs of the first panel to the framework; and slotting the second set of tabs of the second panel between the first panel and the framework.

12. A tab for mounting on a building board, the tab comprising:

a generally rectangular planar body having a raised rim extending around a perimeter of the generally rectangular planar body;

a first end of the generally rectangular planar body including a frustoconical surface extending out of the generally rectangular planar body and raised in the same direction as the raised rim, the frustoconical surface having aperture formed through the top thereof; and a pair of pressed portions positioned on opposed sides of the frustoconical surface, each of the pair of pressed portions forming (a) a dimple indented into the generally rectangular planar body and (b) a corresponding raised nodule on an opposite side of the generally rectangular planar body, the raised nodule extending out of the opposite side of the generally rectangular planar body in the opposite direction as the raised rim.

* * * * *